US005785563A

United States Patent [19]

Peaslee

[11] Patent Number: 5,785,563

[45] Date of Patent: Jul. 28, 1998

[54] SCUBALL

[76] Inventor: Thomas Mark Peaslee, P.O. Box 64091, Sunnyvale, Calif. 94088

[21] Appl. No.: 782,789

[22] Filed: Jan. 13, 1997

[51] Int. Cl.[6] ..... B60L 11/02

[52] U.S. Cl. ..... 440/6; 114/315

[58] Field of Search ..... 440/6, 80, 81; 114/315, 242, 244

[56] References Cited

U.S. PATENT DOCUMENTS

| | | | |
|---|---|---|---|
| 4,571,192 | 2/1986 | Gongwer | 440/81 |
| 4,864,959 | 9/1989 | Takamizawa et al. | 440/6 |
| 5,105,753 | 4/1992 | Chih et al. | 114/315 |
| 5,158,034 | 10/1992 | Hsu | 440/6 |
| 5,303,666 | 4/1994 | DeSantis et al. | 440/6 |
| 5,379,714 | 1/1995 | Lewis et al. | 440/6 |
| 5,423,278 | 6/1995 | Lashman | 440/6 |
| 5,634,423 | 6/1997 | Lashman | 114/315 |

*Primary Examiner*—Ed L. Swinehart

[57] ABSTRACT

A self contained underwater ball ("SCUBall") is a self-powered, aquatic sporting device. The SCUBAll is neutrally buoyant when submerged in water, and has a center of gravity located at the SCUBall's center of buoyancy, and aligned with the axis of hydrodynamic forces. The SCUBall includes a switch, accessible from outside the SCUBall, which upon activation causes said propulsion unit to be energized for a time interval after activation of said switch.

12 Claims, 7 Drawing Sheets

SCUBALL

BACKGROUND OF THE INVENTION

1. Field of the Invention

The present invention relates generally to self-contained, self-propelling underwater devices, and in particular to underwater sporting devices.

2. Description of the Prior Art

At present, if a scuba diver isn't working underwater then he is more or less just a sightseer. The "sport" of scuba diving does not include any truly competitive team games. A need exists for a device that will allow divers to play games underwater just as games are played on land, but enhanced by the weightless and three-dimensional arena available only when submerged in water.

SUMMARY OF THE INVENTION

The present invention provides a device that enhances the underwater experiences of scuba divers.

An object of the present invention is to provide a device that permits scuba divers participation in sporting competition.

The self-contained, underwater ball ("SCUBall") sporting device has neutral buoyancy when submerged in water. The primary function of the SCUBall is to propel itself through the water between scuba divers much like a ball is passed through the air between players on land. In a presently preferred embodiment the SCUBall propels itself through the water by drawing water into a hollow duct through a front intake in the SCUBall's body, and expelling the water forcibly out of a rear exhaust in the SCUBall's body.

These and other features, objects and advantages will be understood or apparent to those of ordinary skill in the art from the following detailed description of the preferred embodiment as illustrated in the various drawing figures.

DETAILED DESCRIPTION OF THE PREFERRED EMBODIMENT

Figure 1:
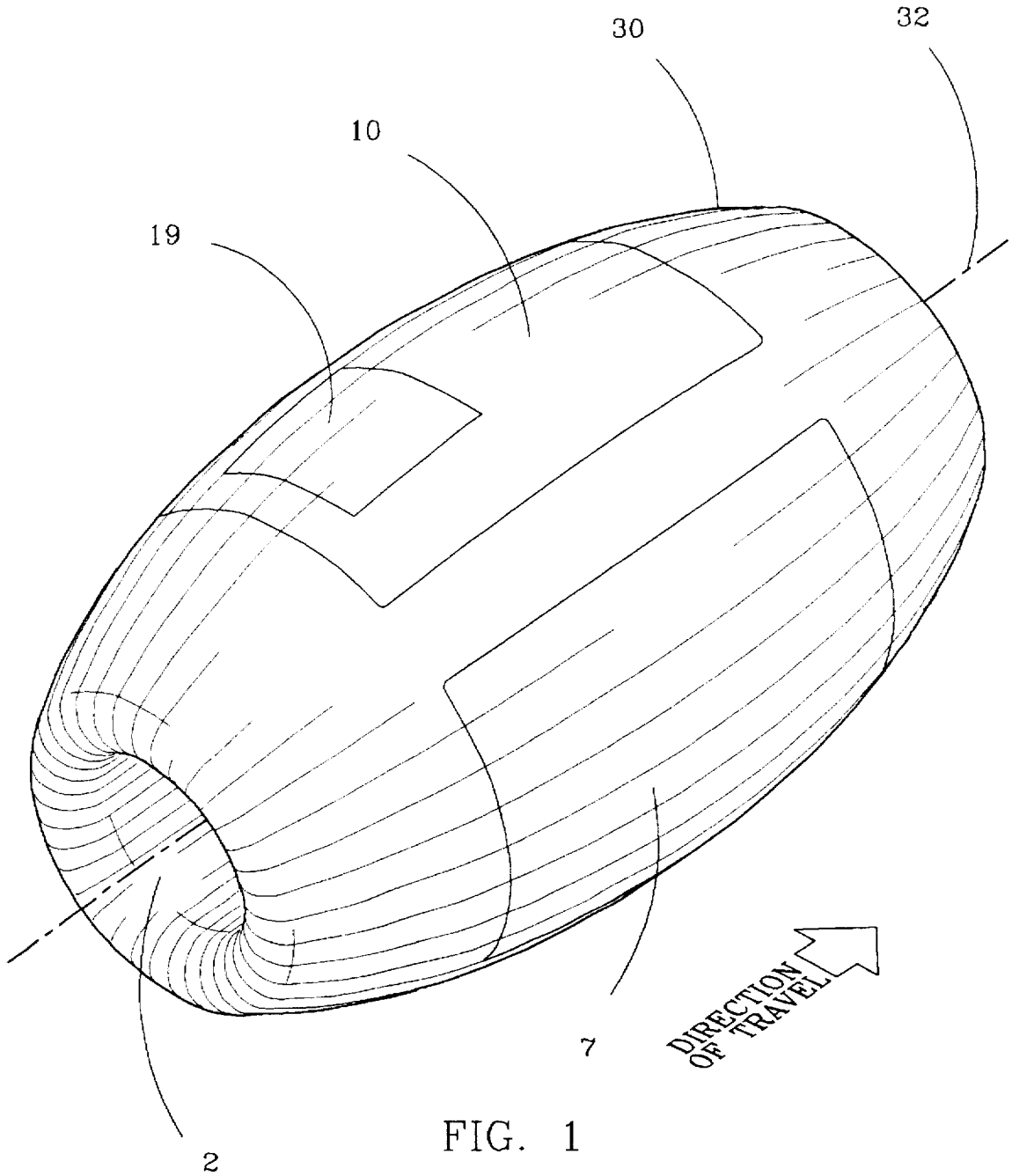
FIG. 1 shows the overall appearance of the SCUBall in an isometric projection.
Figure 1A:
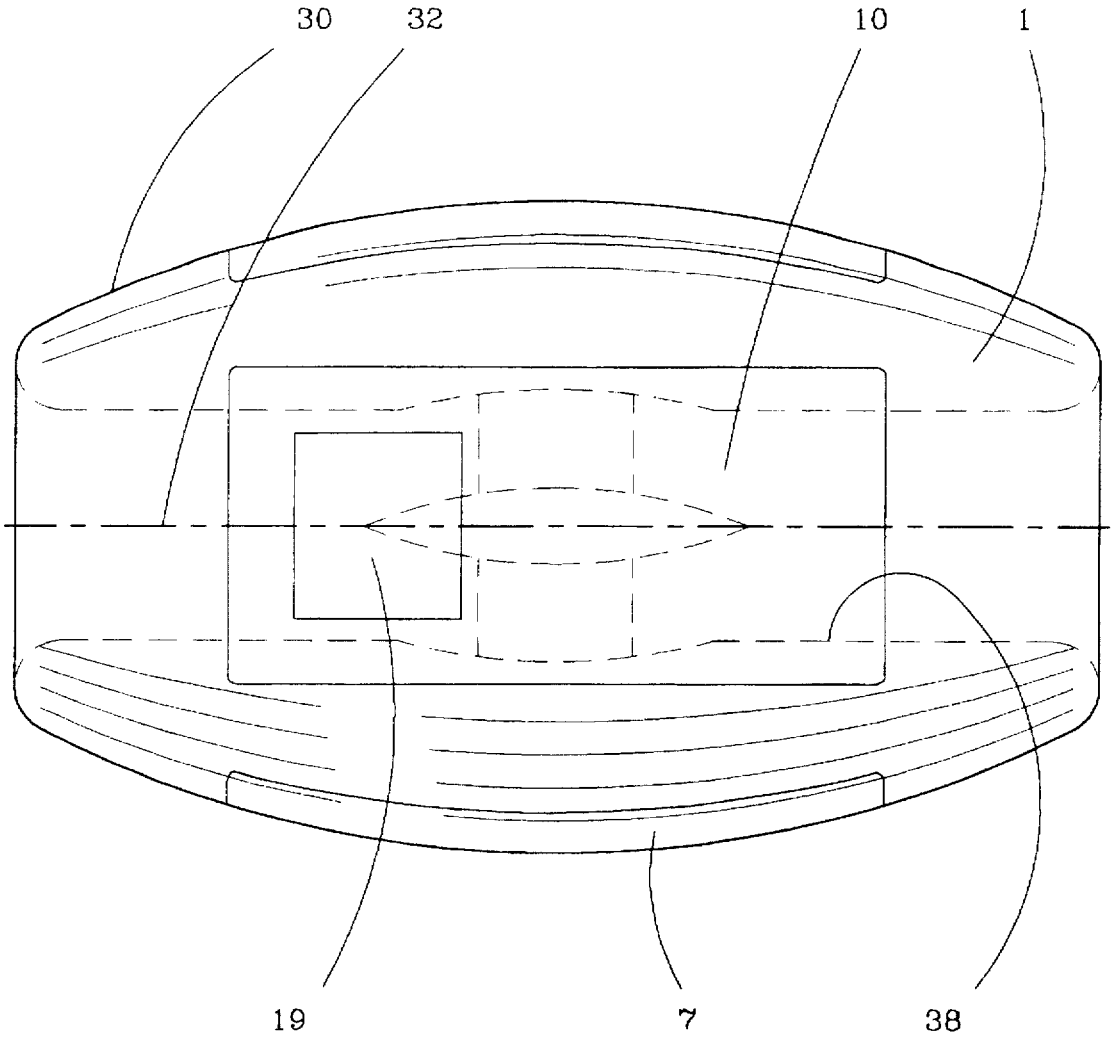
FIG. 1A shows the overall appearance of the SCUBall in an orthographic projection as seen from above the SCUball.
Figure 1B:
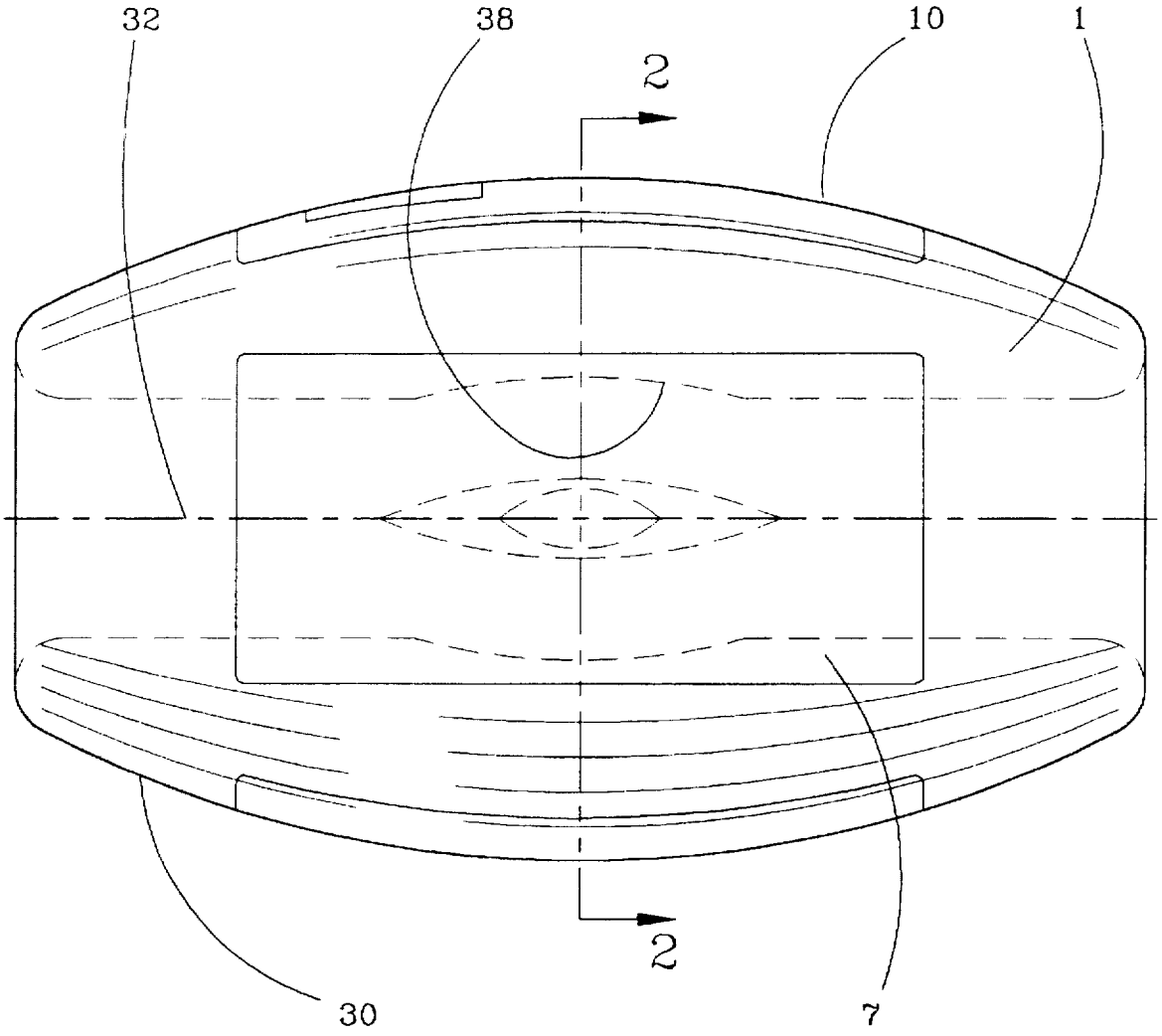
FIG. 1B shows the overall appearance of the SCUBall in an orthographic projection as seen from a right side of the SCUball.
Figure 1C:
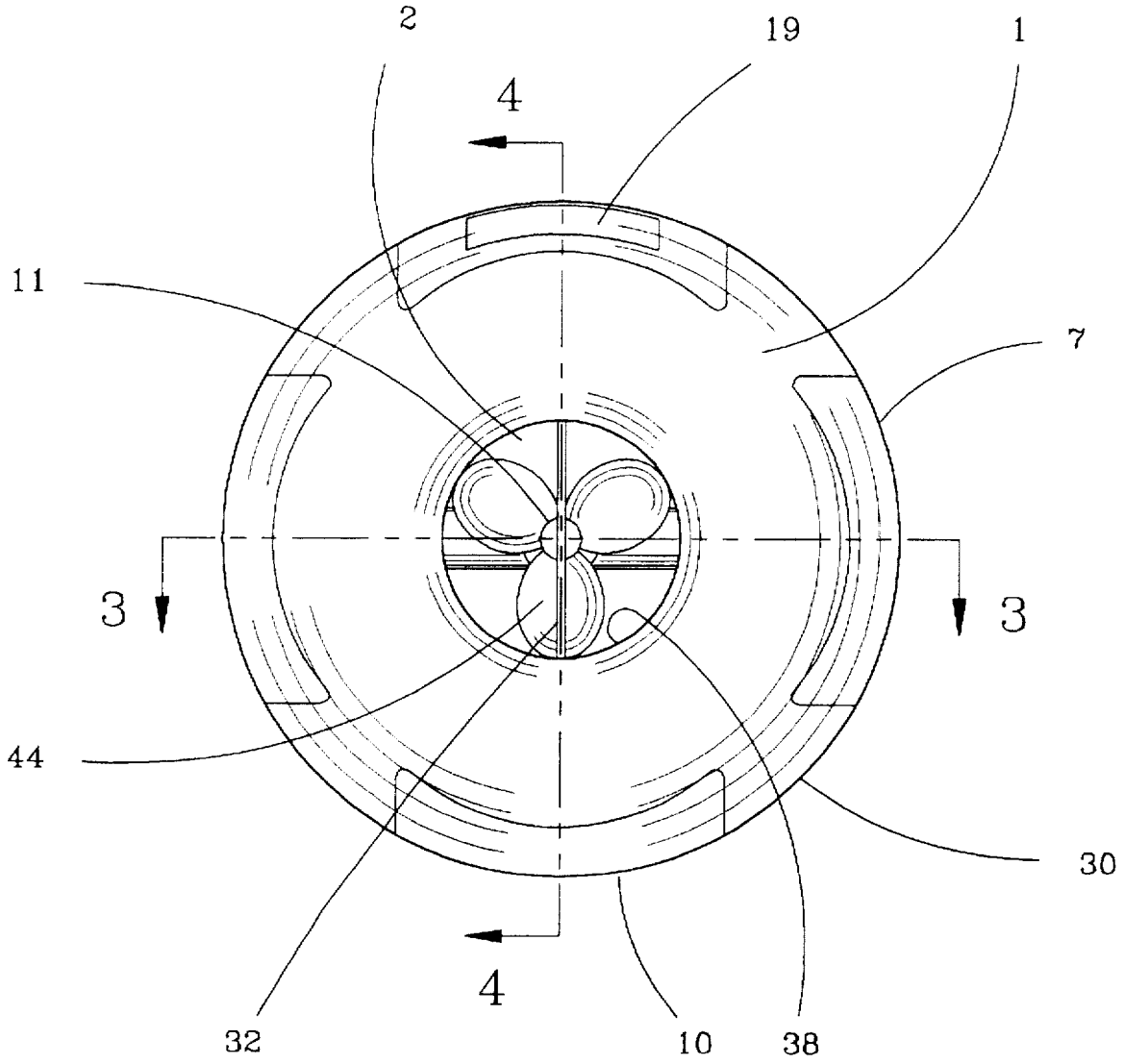
FIG. 1C shows the overall appearance of the SCUBall in an orthographic projection as seen from an aft end of the SCUball.
Figure 2:
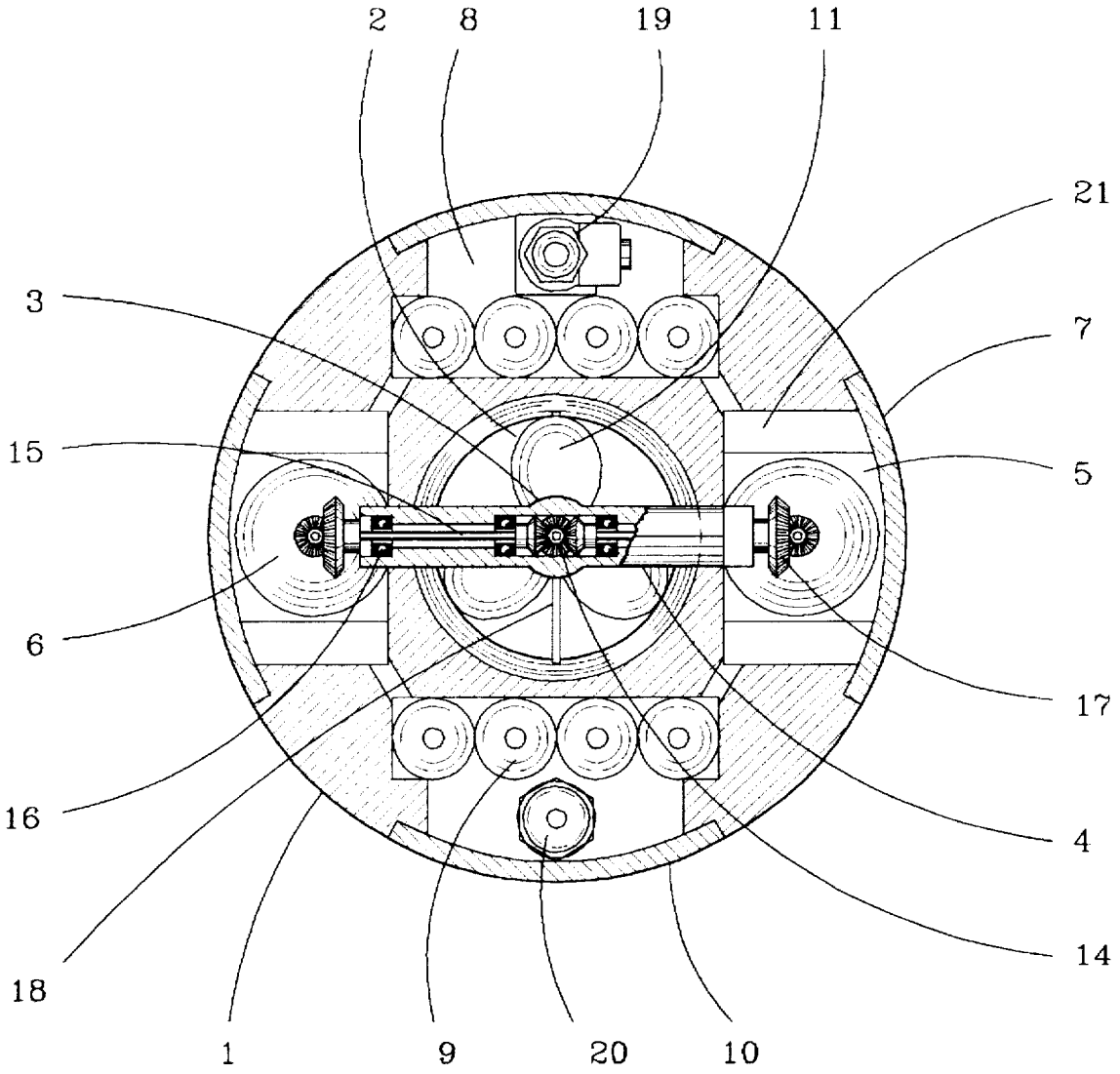
FIG. 2 shows an interior view, labeled "Section 2—2" in FIG. 1B, through a circular center of the SCUBall showing a plane view of a duct and symmetrical placement of motors and batteries within a body of the device.
Figure 3:
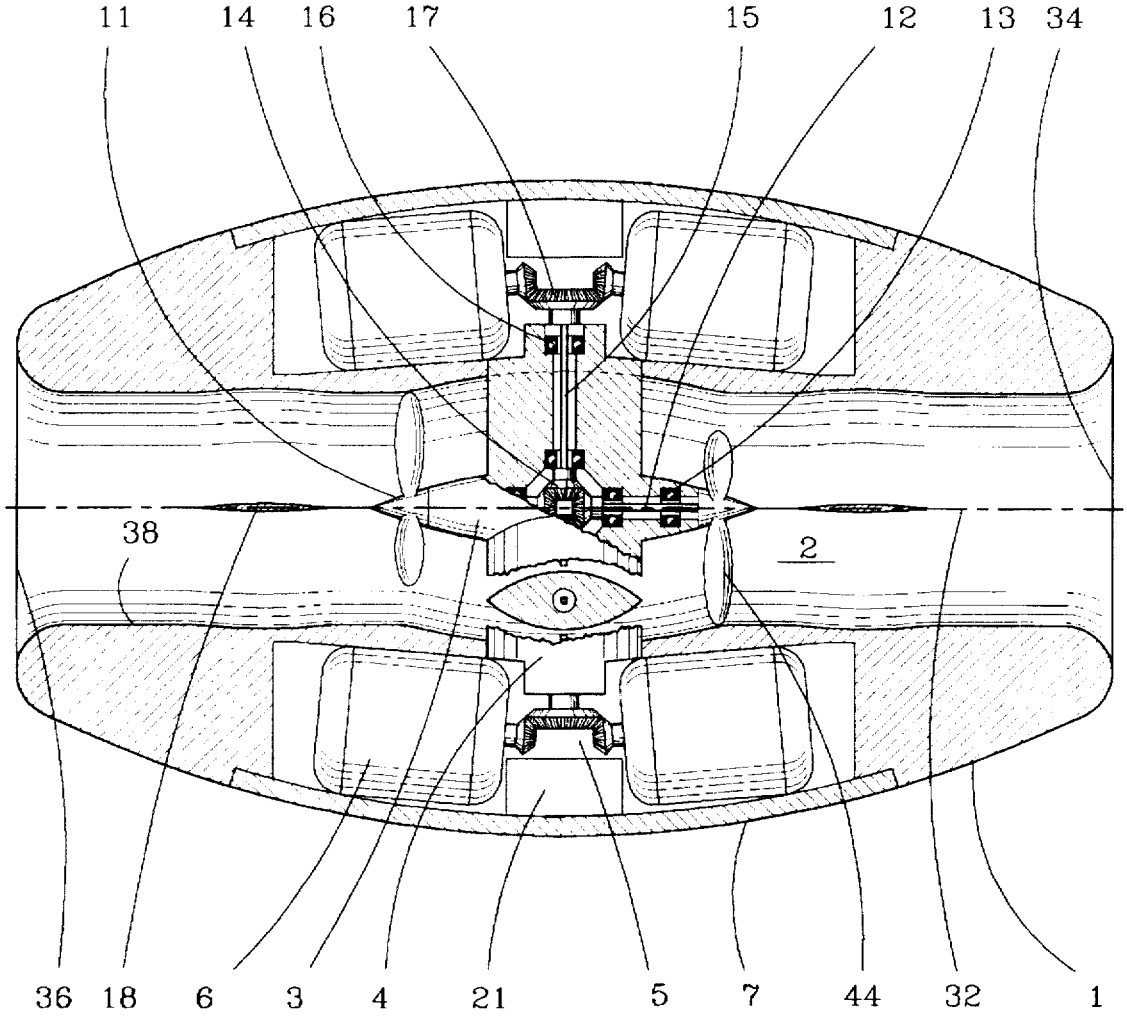
FIG. 3 shows an interior view, labeled "Section 3—" in FIG. 1C, through a long axis of the duct, passing through motor chambers to show a drive train that couples electric motors to propellers included in the SCUBall. Also shown is a revolved view of a pylon cross-section.
Figure 4:
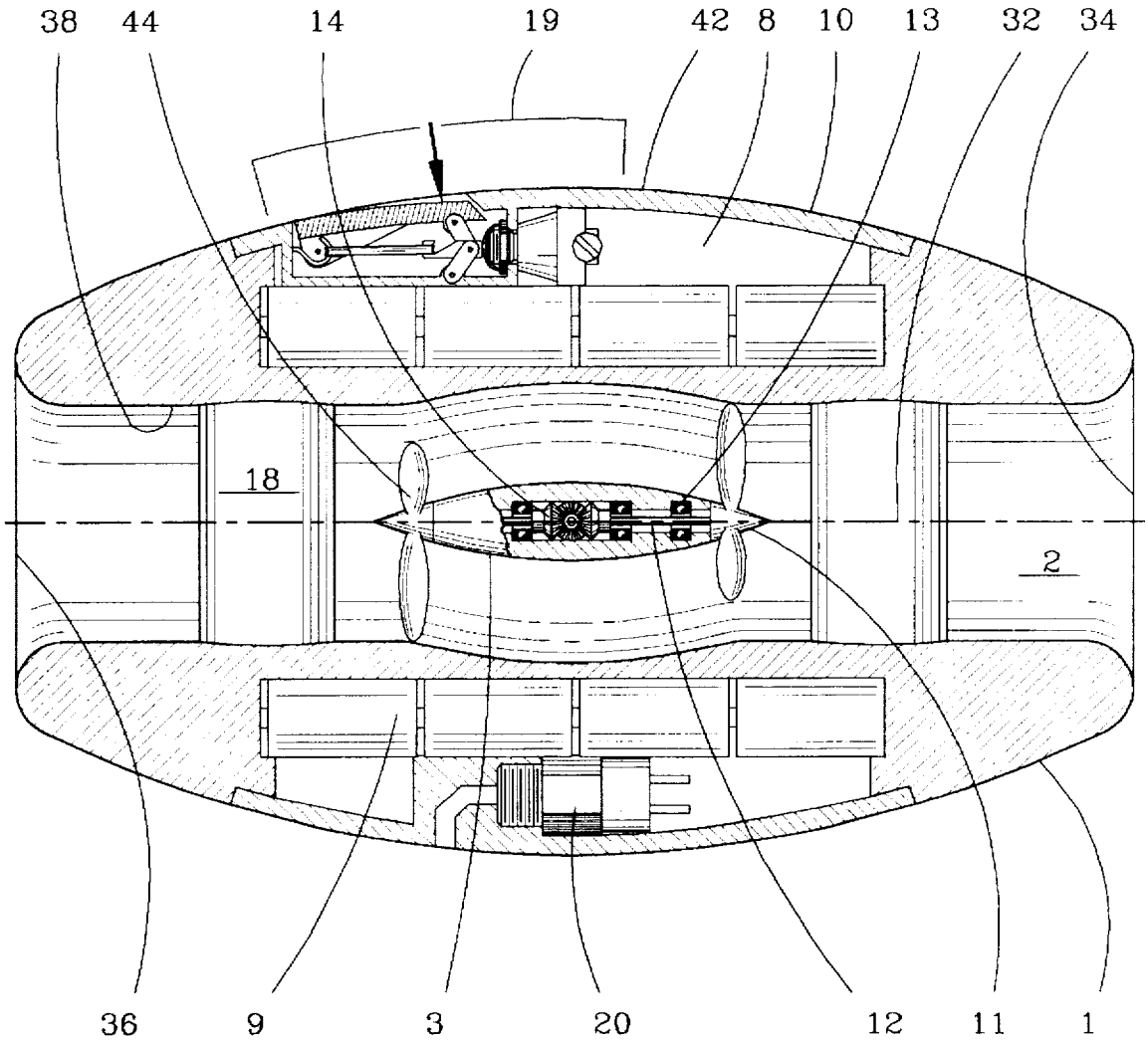
FIG. 4 shows an interior view, labeled "Section 4—4" in FIG. 1C, through the long axis of the duct, passing through battery chambers that shows a control system for the SCUBall.

FIGS. 1, 1A, 1B and 1C depict several different views of a self-contained, underwater ball ("SCUBall") sporting device in accordance with the present invention that is referred to by the general reference character 30. The SCUBall 30 includes an ellipsoid body 1 having a centerline 32 collinear with a longitudinal axis of the body 1. The body 1 is made of a material that withstands an underwater pressure of at least 2 atmospheres. A hollow, circularly-shaped duct 2 pierces the body 1, extends along the longitudinal axis thereof, and surrounds the centerline 32. The duct 2 is open at both ends 34 and 36 of the body 1. As illustrated in FIG. 3 and 4, the hollow duct 2 permits a flow of water to be inducted into the duct 2 at a first end 34 of the body 1 and to be discharged from the duct 2 at a second end 36 thereof. A nacelle 3, located within the duct 2 between the ends 34 and 36, is aligned with the centerline 32 of the duct 2. The nacelle 3 is preferably supported within the duct 2 by two pylons 4 that are oriented at 180 degrees from each other, and that are secured to an inside wall 38 of the duct 2.

Contained within the ellipsoid body 1 surrounding the duct 2 are various chambers 5 and 8 for holding various power and control systems included in the SCUBall 30. There are four enclosed chambers 5 and 8 within the body 1 oriented at 90 degree intervals around the centerline 32, and located between the first end 34 and second end 36 at the middle of the body 1. Each of the chambers 5 and 8 is completely enclosed within the body 1. Each of the chambers 5 and 8 has a water-tight cover 7 or 10 that allows access to the chambers 5 or 8 from outside the body 1. All chambers 5 and 8 are connected by conduits. The conduits allow power and control wiring to pass between the various internal components of the SCUBall 30.

Two of the opposing enclosed chambers contained within the ellipsoid body 1 are motor chambers 5. These motor chambers 5 are located 180 degrees apart and inline with the two pylons 4 supporting the nacelle 3. Housed within each motor chamber 5 are two electric motors 6 for propelling the SCUBall 30. These motor chambers 5 are enclosed by watertight covers 7 to protect the electric motors 6 from the water, yet allow access to the electric motors 6 for maintenance.

The other two opposing enclosed chambers 8 contained within the ellipsoid body 1 are battery chambers 8. These battery chambers 8 are located 90 degrees from the motor chambers 5. Housed within each battery chamber 8 is a series of batteries 9 for powering operation of the SCUBall 30. These battery chambers 8 are enclosed by watertight covers 10 to protect the electrical batteries 9 from the water, yet allow access to the batteries 9 for maintenance.

Two propellers 11 are located within the duct 2, positioned at each end of the nacelle 3. Each propeller 11 rotates in a plane oriented perpendicular to the centerline 32. Diameters of the propellers 11 are such that they just clear the inside wall 38 of the duct 2. Blades 44 of the propellers 11 are oriented such that each propeller 11 rotates in a direction that is opposite to that of the other propeller 11. When rotating in opposite directions, both propellers 11 create a propulsive force in the same direction parallel to the centerline 32. This configuration for the propellers 11, a contra-rotating propulsive system, eliminates any torque that might be imparted to the SCUBall 30 by reaction between the water and the propellers 11.

The propellers 11 derive their rotational power from the electric motors 6 through a series of drive shafts 12 and 15, and mitered gears 14 and 17. A propeller drive shaft 12 is attached to each propeller 11 and passes through a pair of watertight bearings 13 aligned with the centerline axis of the nacelle 3. The propeller drive shafts 12 end at the middle of the nacelle 3 where mitered gears 14 transfer power from a pair of motor drive shafts 15. These motor drive shafts 15 are suspended by a series of bearings 16 within each of the pylons 4 supporting the nacelle 3. The motor drive shafts 15 pass from each pylon 4 into each motor chamber 5. At the end of each of the motor drive shafts 15 is a mitered gear system 17 to transfer power from the electric motors 6 located in that motor chamber 5. As the propellers 11 are designed to turn in opposite directions, so too the drive shafts 12 and electric motors 6 all turn in opposite directions to each other to further eliminate unwanted torque on the SCUBall 30.

Located within the duct 2 in front of each propeller 11 and extending across the duct 2 is a guard 18 that protects the propeller 11 from being fouled by foreign objects. These guards 18 also protect a user of the SCUBall 30 from injuring himself if an appendage should enter the duct 2.

The four electric motors 6 contained within the two opposing motor chambers 5 derive their power from the series of batteries 9 contained within the two opposing battery chambers 8. The electrical current to the electric motors 6 is controlled by a timer switch 19 and a pressure switch 20. The timer switch 19 and the pressure switch 20 are located on an outer surface 42 of the ellipsoid body 1, respectively secured to one of the watertight covers 10 for the battery chambers 8.

After submersion in water, the timer switch 19 is activated by a user of the SCUBall 30 as indicated by an arrow in FIG. 4. Upon activation of the timer switch 19, the electric motors 6 produces power for the contra-rotating propellers 11 for a predetermined interval of time, then electrical power to the electric motors 6 is shut off by the timer switch 19. Automatically shutting off electrical power prevents the SCUBall device from traveling an excessive distance if it is not stopped by another user of the SCUBall 30.

The pressure switch 20 is located so it senses ambient water pressure outside the SCUBall 30. The pressure switch 20 is configured so if water pressure outside the SCUBall 30 exceeds a pre-established limit the pressure switch 20 shuts off the electrical power to the electric motors 6. This prevents the SCUBall 30 from propelling itself to a depth that may be hazardous to a diver, or destructive to the SCUBall 30.

The SCUBall 30 is designed so the weight of the SCUBall 30 equals the weight of the water displaced by the SCUBall 30. This characteristic of the SCUBall 30, combined with the symmetry of its shape and balance, allows the SCUBall 30 to be propelled in any direction. Within the various chambers 5 and 8 of the body 1 are provisions 21 for varying the weight and balance of the SCUBall 30. Thus, the SCUBall 30 may be adjusted to have neutral buoyancy, i.e. weigh as much as the water displaced by the SCUBall 30, and may be adjusted so the center-of-gravity is located at the center-of-buoyancy of the SCUBall 30. Adjusting the weight of the SCUBall 30 permits its operation in differing aquatic environments; i.e., open ocean or a fresh water lake.

Although the present invention has been described in terms of the presently preferred embodiment, it is to be understood that such disclosure is purely illustrative and is not to be interpreted as limiting. Consequently, without departing from the spirit and scope of the invention, various alterations, modifications, and/or alternative applications of the invention will, no doubt, be suggested to those skilled in the art after having read the preceding disclosure. Accordingly, it is intended that the following claims be interpreted as encompassing all alterations, modifications, or alternative applications as fall within the true spirit and scope of the invention.

I claim:

1. A self-contained, underwater ball ("SCUBall") sporting device adapted for self-propulsion through water, the SCUBall comprising:

a body adapted for weight adjustment so that upon immersion of the SCUBall into water the SCUBall has neutral buoyancy;

a propulsion unit supported from said body which upon energizing said propulsion unit urges the SCUBall to move through water in which the SCUBall is immersed; and power system means adapted for energizing said propulsion unit, said power system means including:

a switch accessible from outside said body which upon activation causes said propulsion unit to be energized; and a timer that de-energizes said propulsion unit a pre-established time interval after activation of said switch.

2. The SCUBall of claim 1 wherein the SCUBall has a center-of-buoyancy located at a center-of-gravity for the SCUBall.

3. The SCUBall of claim 2 wherein the SCUBall is hydrostatically symmetrical about the center-of-buoyancy and center-of-gravity of the SCUBall.

4. The SCUBall of claim 2 wherein the center-of-buoyancy and center-of-gravity of the SCUBall are disposed on a longitudinal axis of the SCUBall, and the SCUBall is hydrodynamically symmetrical about the longitudinal axis.

5. The SCUBall of claim 1 wherein said propulsion unit includes a motor that is enclosed within a watertight chamber inside said body.

6. The SCUBall of claim 1 wherein said power system means is enclosed within a watertight chamber inside said body.

7. The SCUBall of claim 1 wherein said propulsion unit of the SCUBall is adapted for eliminating any torque due to reaction between said propulsion unit and water in which the SCUBall is immersed while said propulsion unit is energized.

8. The SCUBall of claim 1 wherein the SCUBall further comprises a pressure switch for sensing ambient water pressure about the SCUBall and, if the ambient water pressure exceeds a pre-established limit, the pressure switch de-energizes said propulsion unit.

9. The SCUBall of claim 1 wherein said body is pierced by a hollow duct that is open at opposite ends of said body.

10. The SCUBall of claim 9 wherein said propulsion unit includes a nacelle supported within the duct, said propulsion unit being adapted for moving the SCUBall through water by drawing water in a first end of the duct, impelling the water through the duct, and discharging the water from a second end of the duct.

11. The SCUBall of claim 10 wherein said propulsion unit includes a pair of contra-rotating propellers that are exposed to water in which the SCUBall is immersed, and that are configured to eliminate any torque due to reaction between the rotating propellers and water in which the SCUBall is immersed while said propulsion unit is energized.

12. The SCUBall of claim 11 wherein rotation the propellers is effected by an electric motor that is enclosed within a watertight chamber inside said body, and wherein said power system means includes a battery that is enclosed within a watertight chamber inside said body.

* * * * *